US007857408B2

(12) United States Patent
Yokozawa

(10) Patent No.: US 7,857,408 B2
(45) Date of Patent: Dec. 28, 2010

(54) RECORDING DEVICE AND RECORDING CONTROL METHOD

(75) Inventor: Taku Yokozawa, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 130 days.

(21) Appl. No.: 11/365,179

(22) Filed: Mar. 1, 2006

(65) Prior Publication Data

US 2006/0197786 A1 Sep. 7, 2006

(30) Foreign Application Priority Data

Mar. 7, 2005 (JP) ..... 2005-063155

(51) Int. Cl.
*B41J 29/38* (2006.01)

(52) U.S. Cl. ..... 347/14

(58) Field of Classification Search ..... None
See application file for complete search history.

(56) References Cited

U.S. PATENT DOCUMENTS 6,377,358 B1 * 4/2002 Hayasaki et al. ..... 358/1.16
6,962,399 B2 * 11/2005 Anderson et al. ..... 347/14
2005/0041082 A1 2/2005 Kataoka
2005/0156979 A1 * 7/2005 Chang ..... 347/19

FOREIGN PATENT DOCUMENTS

JP 11-138803 5/1999
JP 2004-136507 A 5/2004
JP 2004-155831 A 6/2004

OTHER PUBLICATIONS

Translation for JP 2004-136507 A.*

* cited by examiner

*Primary Examiner*—Matthew Luu
*Assistant Examiner*—Justin Seo
(74) *Attorney, Agent, or Firm*—Canon U.S.A. Inc., I.P. Division

(57) ABSTRACT

A recording device counts the number of pulsed signals applied to drive a recording head after the device determines that ink tanks have been interchanged. The recording device compares the number of pulsed signals counted after the interchange of the ink tanks with a predetermined threshold to change the energy supplied to drive the recording head according to the comparison.

7 Claims, 8 Drawing Sheets

RECORDING DEVICE AND RECORDING CONTROL METHOD

BACKGROUND OF THE INVENTION

1. Field of the Invention

The present invention relates to recording devices and recording control methods, and particularly relates to a recording device and a recording control method for recording by ejecting ink from, for example, an inkjet recording head onto a recording medium.

2. Description of the Related Art

As information processing devices such as copiers, word processors, and computers and communication equipment become widely available, digital image recording devices for such devices are rapidly becoming widespread, including those having an inkjet recording head (hereinafter referred to as a recording head). Recording heads used for such recording devices have densely arranged ink outlets and ink channels serving as a recording element array composed of densely arranged recording elements to achieve higher recording speeds. Typical recording heads have a plurality of recording element arrays to provide color recording.

Recently, there has been an increasing demand for higher-quality image recording using recording devices both in a normal recording mode in which line images such as characters are recorded on recording media such as plain paper and in a photo-quality mode in which natural images are recorded with high image quality on recording media such as glossy paper.

The ink properties required differ between glossy paper, which has a coating layer, and other recording media such as plain paper, which has less absorbency and color development properties. For example, important factors for glossy paper include glossiness, graininess, and chroma while those for plain paper include density and absorption speed.

Different types of inks are used for recording according to the properties of recording media and the image quality for recording. For black inks, particularly, different types of inks are preferably used for different types of images for recording. For glossy paper, for example, a photo black ink is preferred for its low image graininess and excellent glossiness for mixed colors. For plain paper, on the other hand, a matte black ink is preferred for its excellent color development properties. Japanese Patent Laid-Open No. 2004-155831 (corresponding to U.S. patent application Ser. No. 2005-041082) discloses a recording system capable of utilizing the two types of inks.

Thus, the use of appropriate inks according to the type of recording media is a general method for supporting recording media with different properties. Indiscriminately increasing the number of inks used, however, results in bulky recording heads with an increased number of recording element arrays corresponding to the individual inks. Recording devices having such recording heads are bulky and often contribute to increased cost.

Japanese Patent Laid-Open No. 2004-136507 discloses a recording device capable of interchanging ink sets according to the properties of recording media and user demands.

This device allows the interchangeable use of, for example, an ink set suitable for high-speed recording and another ink set suitable for photo-quality mode.

The above known systems, however, leave the problems described below:

For the interchangeable use of different types of inks for the same recording element array, the inks are difficult to completely interchange; a residue of the ink used before the interchange may be mixed in the ink used after the interchange in a recording head and ink supply channels. If the content of the residual ink is low, the mixed ink is often similar in image quality to the ink used after the interchange. The mixed ink, however, can be unstable in terms of ejection properties and reliability. If, particularly, the inks used before and after the interchange are pigment inks, the dispersants used for pigment dispersion often deteriorate, leading to degraded dispersibility. As a result, the pigment particles aggregate and obstruct the control of recording elements. This results in unstable ink ejection.

The mixed ink can be completely replaced with the ink used after the interchange by draining the ink remaining in the recording head and the ink supply channels using a built-in recovery mechanism or by ejecting and consuming the residual ink in a non-recording region in the recording device. Completely draining the ink remaining in the recording head and the ink supply channels, however, increases the amount of ink consumed in each interchange operation and thus raises operating cost. Complete draining after the interchange operation is also disadvantageous because it makes it difficult to reduce the time required for ink interchange.

SUMMARY OF THE INVENTION

The present invention is directed to a recording device and a recording control method that avoid unstable ink ejection occurring when the inks used before and after the interchange of ink tanks are mixed after incomplete ink interchange and that enable high-quality image recording without unnecessary ink consumption in the interchange of the ink tanks.

In one aspect of the present invention, a recording device for recording an image includes a recording head configured to eject ink; an ink tank adapted to store the ink to be supplied to the recording head, the ink tank being one of first and second ink tanks, and the first ink tank being interchangeable with the second ink tank; a determining unit determining whether the first and second ink tanks have been interchanged; a drive unit driving the recording head by applying pulsed signals to the recording head to supply energy thereto; a counting unit counting the number of pulsed signals applied to the recording head; a comparing unit comparing a predetermined threshold with the number of pulsed signals counted by the counting unit responsive to the determining unit determining that the first and second ink tanks have been interchanged; and a drive control unit controlling the energy supplied to the recording head according to the comparison by the comparing unit.

According to another aspect of the present invention, there is provided a recording control method for controlling the recording of an image by the ejection of ink from a recording head that is supplied with the ink from an ink tank interchangeable with another ink tank. This method includes the steps of determining whether the ink tanks have been interchanged, driving the recording head for image recording by applying pulsed signals to the recording head to supply energy thereto, counting the number of pulsed signals applied to drive the recording head, and controlling the recording head by changing the energy supplied to drive the recording head according to a comparison of a predetermined threshold and the number of pulsed signals counted in the counting step after determining that the ink tanks have been interchanged in the determining step.

According to yet another aspect of the present invention, a recording device for recording an image includes a recording head configured to eject ink; an ink tank adapted to store the ink to be supplied to the recording head, the ink tank being one of first and second ink tanks, and the first ink tank being interchangeable with the second ink tank; an interchange-determining unit determining whether the first and second ink tanks have been interchanged; a drive unit driving the recording head by applying pulsed signals to the recording head to supply energy thereto; a consumption-determining unit determining ink consumption after the interchange of the first and second ink tanks; and a drive control unit changing the energy supplied to drive the recording head according to whether the ink consumption determined by the consumption-determining unit reaches a predetermined level after the interchange-determining unit determines that the first and second ink tanks have been interchanged.

In yet still another aspect of the present invention, there is provided a recording control method for controlling the recording of an image by the ejection of ink from a recording head that is supplied with the ink from an ink tank interchangeable with another ink tank. This method includes the steps of determining whether the ink tanks have been interchanged, driving the recording head for image recording by applying pulsed signals to the recording head to supply energy thereto, determining ink consumption after the interchange of the ink tanks, and controlling the recording head by changing the energy supplied to drive the recording head according to whether the ink consumption determined in the consumption-determining step reaches a predetermined level after determining that the ink tanks have been interchanged in the interchange-determining step.

According to the present invention, the energy supplied to a recording head to eject ink may be changed according to a measure of ink consumption after the interchange of ink tanks if a mixed ink is left in the recording device after the interchange of the ink tanks.

Immediately after the interchange of the ink tanks, for example, the energy supplied to drive the recording head may be increased to avoid unstable ink ejection and achieve high positional accuracy with which ink droplets are landed on a recording medium, thus enabling high-quality image recording. The ink ejection becomes stable after the subsequent ink consumption because the mixed ink is completely replaced with the ink used after the interchange. Accordingly, the energy supply may be reduced so as not to affect the lifespan of the recording head.

The present invention is also advantageous in that unnecessary ink consumption can be avoided by minimizing the number of forcible ink discharge operations, including extra suction recovery operations and preliminary ejection operations.

Further features of the present invention will become apparent from the following description of exemplary embodiments with reference to the attached drawings.

DESCRIPTION OF THE EMBODIMENTS

Embodiments of the present invention will now be described in detail with reference to the drawings.

In this specification, the term "recording" (also referred to as "printing") means not only the recording of significant information such as characters and figures, but also the formation of, for example, images and patterns on recording media.

The term "recording medium" means not only paper used for general recording devices, but also any other media capable of carrying ink, including cloth, plastic films, metal plates, glass, ceramics, lumber, and leather.

The term "ink" (also referred to as "liquid"), as well as the definition of the term "recording," should be widely interpreted. In this specification, the term "ink" means any liquid that is provided on recording media to form, for example, images and patterns. In this specification, additionally, the term "ink" also means any liquid used for ink processing (for example, the solidification or insolublization of coloring agents contained in inks provided on recording media).

Unless otherwise specified, the term "nozzle" refers collectively to outlets, ink channels communicating with outlets, and elements that generate ink ejection energy.

First Embodiment

Figure 1:
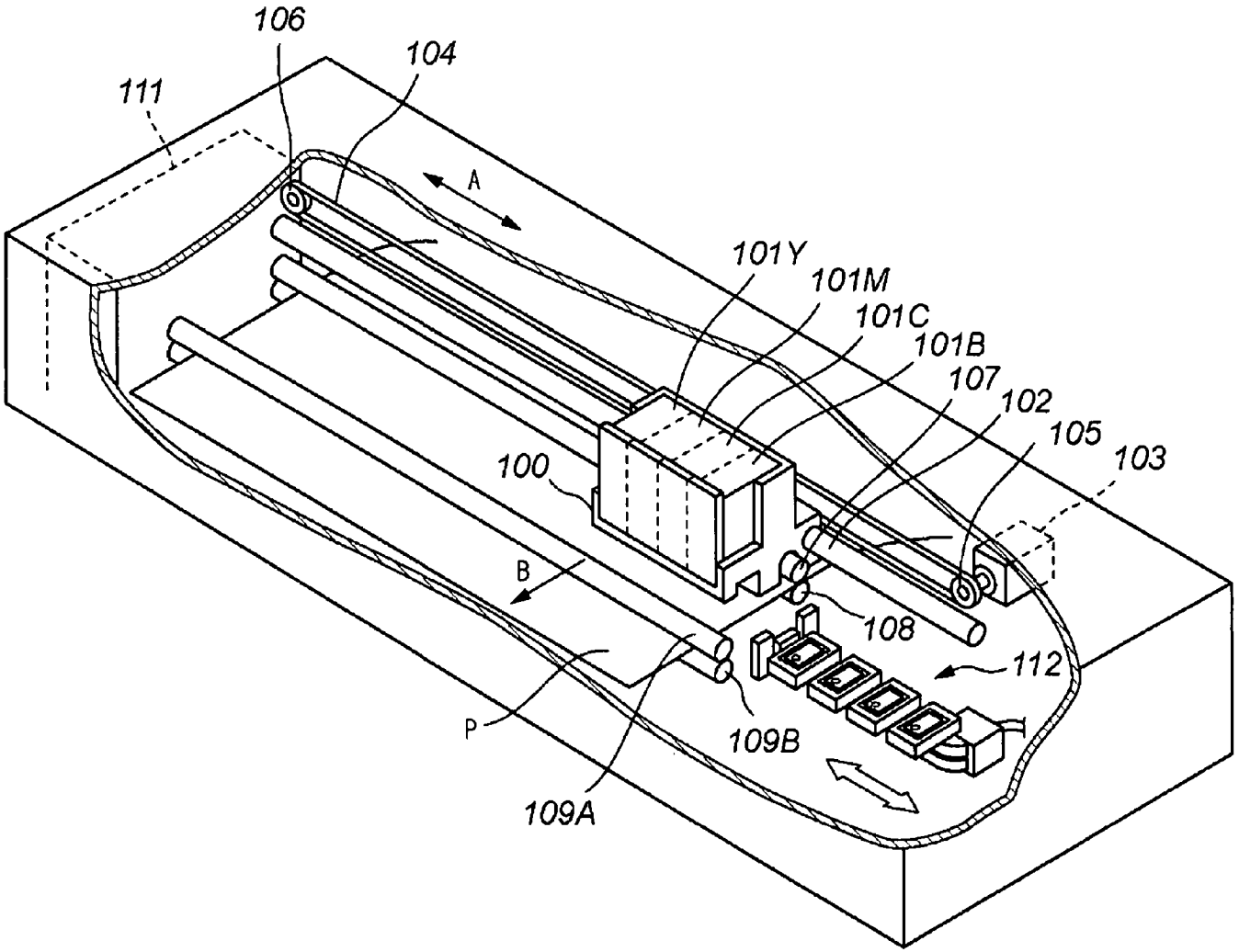
FIG. 1 is a partial cutaway perspective view of a serial-scan recording device including inkjet recording heads according to a first embodiment of the present invention.

FIG. 1 is a partial cutaway perspective view of a serial-scan recording device including inkjet recording heads (hereinafter referred to as recording heads) according to a first embodiment of the present invention.

In FIG. 1, a carriage 100 reciprocates in a direction indicated by arrow A. Four ink tanks corresponding to ink colors and recording heads corresponding to the ink tanks are detachably attached to the carriage 100. The four ink tanks are, for example, an ink tank 101Y containing yellow (Y) ink, an ink tank 101M containing magenta (M) ink, an ink tank 101C containing cyan (C) ink, and an ink tank 101B containing black (Bk) ink.

For the black ink tank 101B, a photo black ink tank suitable for glossy paper and a matte black ink tank suitable for plain paper can be interchangeably attached to the carriage 100. An ink sensor (not shown) is provided at the position of the black ink tank 101B to determine which of the photo black ink tank and the matte black ink tank is attached.

The carriage 100 is supported by a guide shaft 102 and is reciprocated in the direction indicated by arrow A along the guide shaft 102 by an endless belt 104 driven forward or backward by a carriage motor 103. The endless belt 104 runs around pulleys 105 and 106.

For example, a recording medium P such as paper is conveyed intermittently in a direction, indicated by arrow B, perpendicular to the direction indicated by arrow A. The recording medium P is held between a pair of upstream roller units 107 and 108 and a pair of downstream roller units 109A and 109B. The recording medium P can therefore be conveyed with its flatness maintained with respect to the recording heads by a predetermined tension. The roller units 107, 108, 109A, and 109B are driven by a drive unit 111. They may also be driven by the carriage motor 103 described above.

The carriage 100 is stopped at a home position at the start of or during recording if necessary. A capping member 112 for capping the outlet surfaces of the recording heads is disposed at the home position. The capping member 112 is connected to a suction recovery unit (not shown) for preventing clogging of the outlets in the outlet surfaces by forcible suction. This suction recovery unit drains residual inks from the recording heads and ink supply channels before the interchange of inks to minimize the content of the ink used before the interchange.

Figure 2:
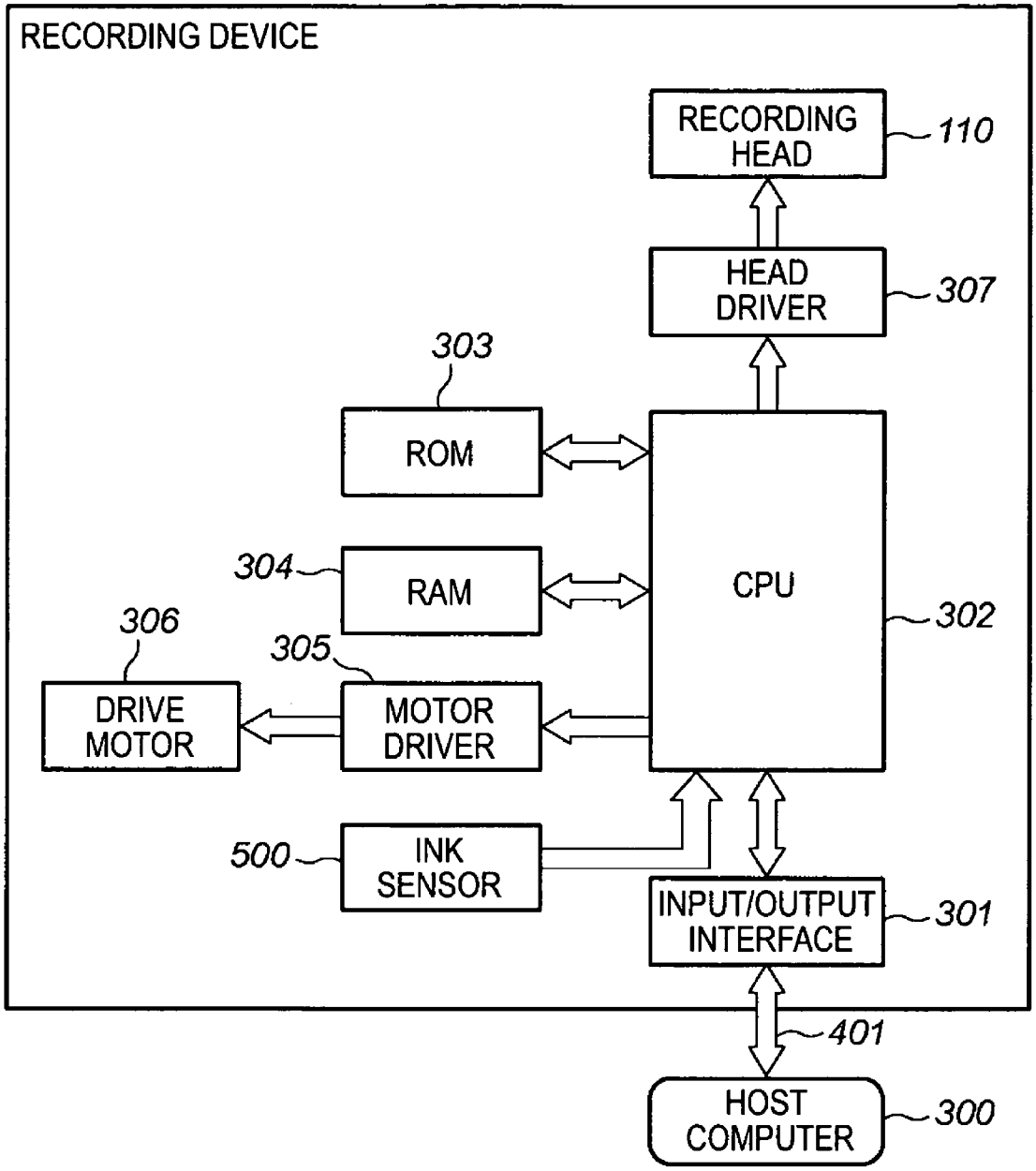
FIG. 2 is a block diagram of the control system of the recording device shown in FIG. 1.

FIG. 2 is a block diagram of the control system of the recording device shown in FIG. 1.

In FIG. 2, the recording device receives recording signals and control signals from a host computer (hereinafter referred to as a host) 300 through an input/output interface 301. The received recording signals are temporarily stored in a receive buffer of the input/output interface 301, converted into data processable in the recording device, and inputted to a CPU 302. The CPU 302 then reads and executes a control program stored in a ROM 303 to process the input data into recording data (image data) using peripheral units such as a RAM 304.

The CPU 302 receives information on the ink tank in use from an ink sensor 500 so that the CPU 302 can change drive signals for input to a recording head 110. The drive signals and the image data are transmitted to the recording head 110 through a head driver 307, while motor drive data is transmitted to a drive motor 306 through a motor driver 305. This process allows image formation with controlled timing.

The ink sensor 500 also functions to detect that the ink tank in use is interchanged with a new ink tank and to notify the CPU 302 of the interchange of the ink tanks. The interchange may also be detected using an additional independent sensor.

Examples of the drive motor 306 herein include the carriage motor 103 and a conveyor motor for conveying the recording medium P.

Figure 3:
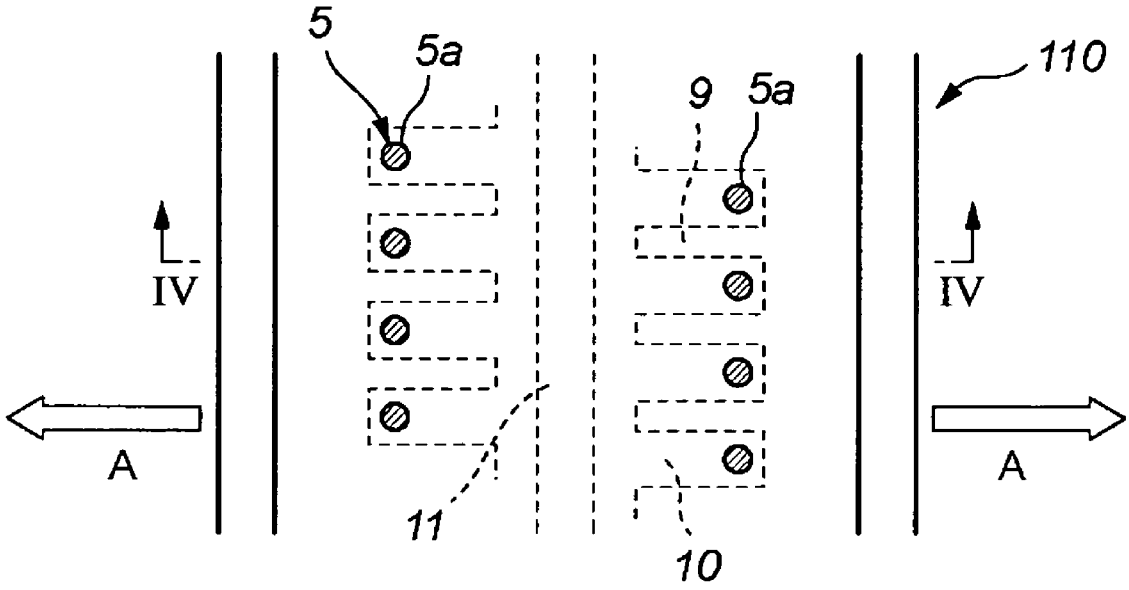
FIG. 3 is a plan view of the main part of the recording head.
Figure 4:
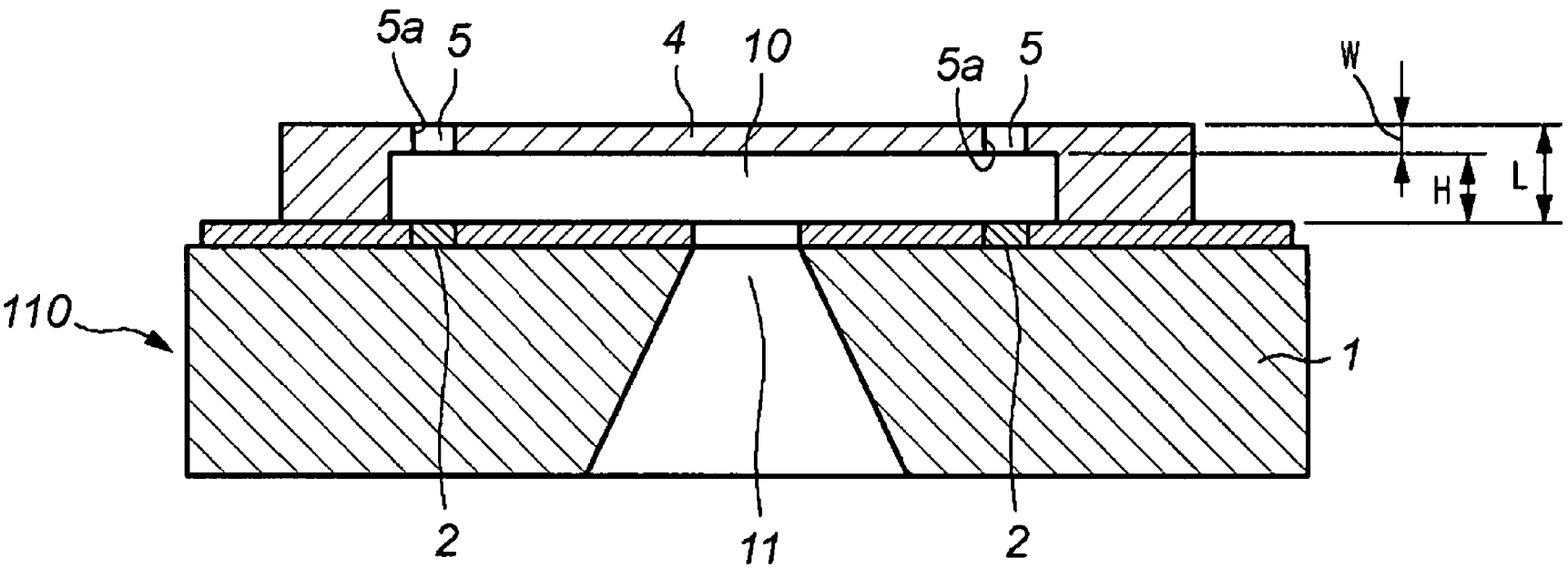
FIG. 4 is a sectional view taken along line IV-IV in FIG. 3.

FIG. 3 is a plan view of the main part of the recording head 110. FIG. 4 is a sectional view taken along line IV-IV in FIG. 3.

In FIGS. 3 and 4, the recording head 110 includes a silicon substrate 1, thermoelectric converters (heaters) 2, an orifice plate 4, outlets 5 defined by edges 5*a*, and ink channels 10 formed between the substrate 1 and the orifice plate 4 and separated by partitions 9. The thermoelectric converters 2 are disposed on the substrate 1 opposite the outlets 5 and are covered with, for example, a protective film. Ink is supplied to the individual ink channels 10 from a common ink chamber communicating with the ink channels 10 (on the bottom side of FIG. 4).

In the recording head 110 according to this embodiment, an ink inlet 11 is formed in the substrate 1 by anisotropic etching. The ink flows from the ink inlet 11 to the ink channels 10 and is ejected from the outlets 5 in the form of ink droplets. The outlets 5, as shown in FIG. 3, are arranged in two arrays in a staggered pattern. Each of the arrays includes 640 outlets arranged at a pitch of 600 dpi. The two arrays are substantially equivalent to a single array of outlets arranged at a pitch of 1,200 dpi because the two arrays are shifted from each other by half the pitch thereof.

The thermoelectric converters 2 are disposed nearly directly below the outlets 5. The components of the ink channels 10, including the partitions 9, are formed by known techniques such as exposure and etching. The outlets 5 are cylindrical holes with a diameter of about 20 μm. The thermoelectric converters 2 have a size of about 24 μm by 24 μm. The ink channels 10, which are formed between the substrate 1 and the orifice plate 4, have a height (H) of about 15 μm. The orifice plate 4 has a thickness (W) of about 10.5 μm. The substrate 1 and the outer surface of the orifice plate 4 are separated by a distance (L) of about 25.5 μm. Although the four recording heads corresponding to the four inks are provided as the recording head 110 in this embodiment, the description below will focus on the recording head for the black ink because their principles of operation are basically the same.

Figure 5:
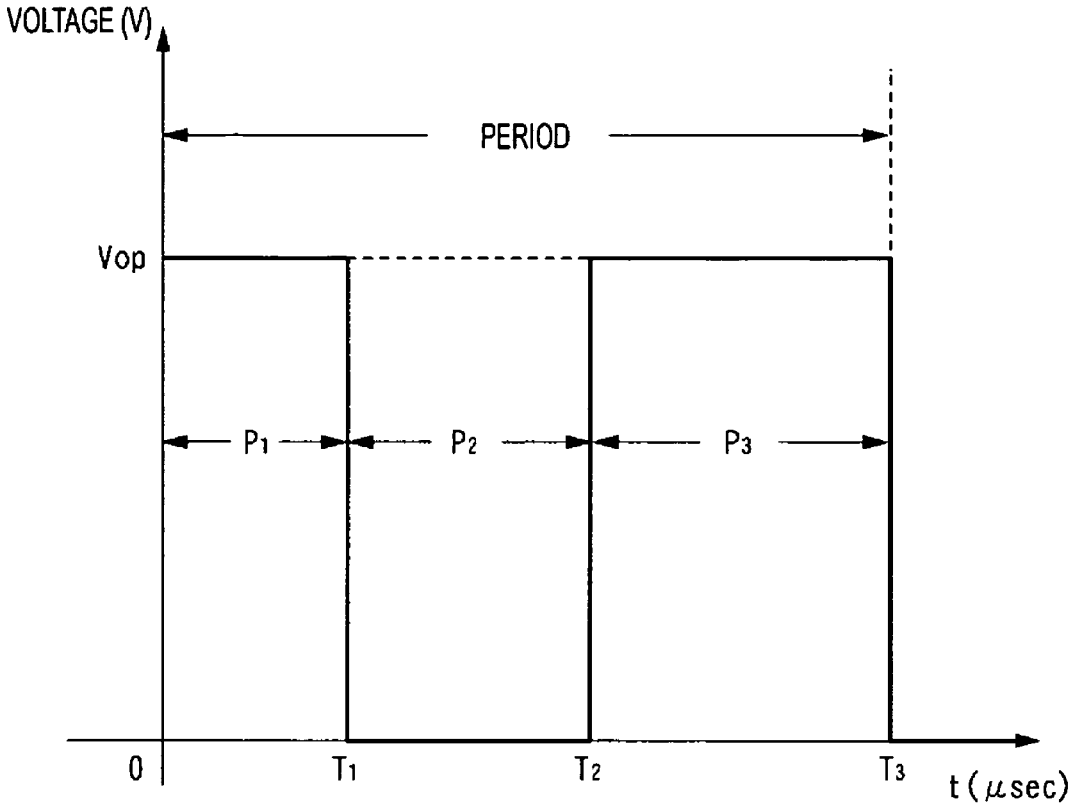
FIG. 5 is a graph showing divided pulses used for supplying energy to the recording head.

FIG. 5 is a graph showing divided pulses used for supplying energy to the recording head 110.

In FIG. 5, $V_{op}$ represents drive voltage; $P_1$ represents the width of the first pulse of divided heat pulses (hereinafter referred to as a preheat pulse); $P_2$ represents a time interval; $P_3$ represents the width of the second pulse (hereinafter referred to as a main heat pulse); and $T_1$, $T_2$, and $T_3$ represent times that define the preheat pulse $P_1$, the interval time $P_2$, and the main heat pulse $P_3$, respectively.

The drive voltage $V_{op}$ is applied to the thermoelectric converters 2 which in turn generate and supply heat energy to the ink in the ink channels 10. The electrical energy required for generating the heat energy depends on the area, resistance, and film structure of the thermoelectric converters 2 and the structure of the ink channels 10. According to the divided-pulse drive method, the preheat pulse $P_1$ and the main heat pulse $P_3$ are sequentially supplied at the time interval $P_2$. The preheat pulse $P_1$ is a pulse used mainly for controlling the temperature of the ink in the ink channels 10. The preheat pulse $P_1$ is adjusted so that the thermoelectric converters 2 do not generate such heat energy that the ink bubbles.

The time interval $P_2$ is inserted to prevent the mutual interference of the preheat pulse $P_1$ and the main heat pulse $P_3$ and to allow the ink in the ink channels 10 to have a uniform temperature distribution. The main heat pulse $P_3$ is used to bubble the ink in the ink channels 10 and eject it from the outlets 5. The main heat pulse $P_3$ plays an important role in the ejection control according to the present invention because the main heat pulse $P_3$ directly affects the ejection of the ink. The width of the main heat pulse $P_3$ depends on the area, resistance, and film structure of the thermoelectric converters 2, the structure of the ink channels 10, and the type of ink.

The recording device according to this embodiment is controlled so that the energy supplied to a mixed ink left after the interchange of the inks differs from the energy supplied after the mixed ink is completely replaced.

In this embodiment, the black inks used before and after the interchange are pigment inks with different compositions. The mixed ink left after the interchange causes the dispersants used for pigment dispersion to deteriorate. This leads to degraded dispersibility which results in the aggregation of the pigment molecules. Use of the ink containing the aggregated pigment molecules decreases the efficiency in controlling the recording elements, namely ejection performance. To prevent the decrease in ejection performance due to the mixed ink, the width of the main heat pulse $P_3$ is adjusted so as to supply different drive energies to the thermoelectric converters 2, thereby controlling the bubbling efficiency thereof. Note that the width of the main heat pulse $P_3$ is synonymous with the duration thereof.

Figure 6:
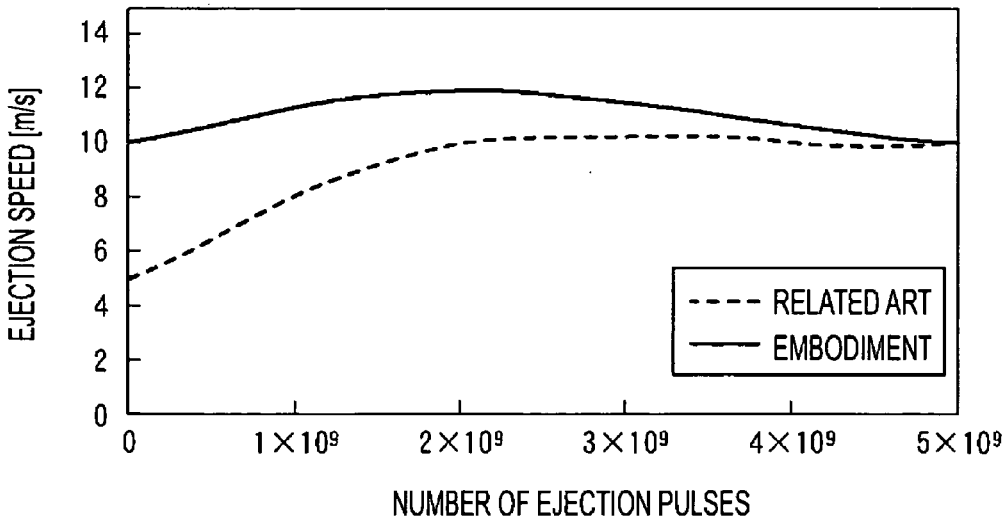
FIG. 6 is a graph showing the relationship between the number of ejection pulses and ink ejection speed after the interchange of black inks for the recording device according to the first embodiment and a recording device of the related art.

FIG. 6 is a graph showing the relationship between the number of ejection pulses and ink ejection speed after the interchange of the black inks for the recording device according to the first embodiment and a recording device of the related art. For the recording device of the related art, the width of the main heat pulse $P_3$ is adjusted to 0.5 μs.

In FIG. 6, the number of ejection pulses represents the cumulative number of ejection pulses after the interchange of ink tanks. The number of ejection pulses is reset to zero when the ink tanks are interchanged.

For the recording device of the related art, as shown in FIG. 6, the ejection speed remains less than normal until about $2\times10^9$ ejection pulses are supplied. The ejection speed increases with increasing ink consumption (i.e., increasing number of ejection pulses supplied) to level off at about 10 m/s. Such unstable ejection performance results from the mixed ink left after the interchange of the ink tanks. The mixed ink remains in, for example, the ink channels 10 of the recording head 110 until the amount of ink equivalent to about $2\times10^9$ ejection pulses is consumed. The unstable ejection performance due to the mixed ink often decreases the positional accuracy with which ink droplets are ejected and landed, thus leading to defective images.

The recording device according to this embodiment, by contrast, ensures stable ejection performance by controlling the width of the main heat pulse $P_3$ to 0.62 μs until $2\times10^9$ ejection pulses are supplied. In addition, the recording device changes the width of the main heat pulse $P_3$ to 0.5 μs when the amount of ink equivalent to about $2\times10^9$ ejection pulses is consumed after the interchange of the ink tanks.

As shown in FIG. 6, such control ensures high ink ejection speed even when the number of ejection pulses is still low, that is, immediately after the interchange of the ink tanks.

The control described above is summarized in FIG. 7.

Figure 7:
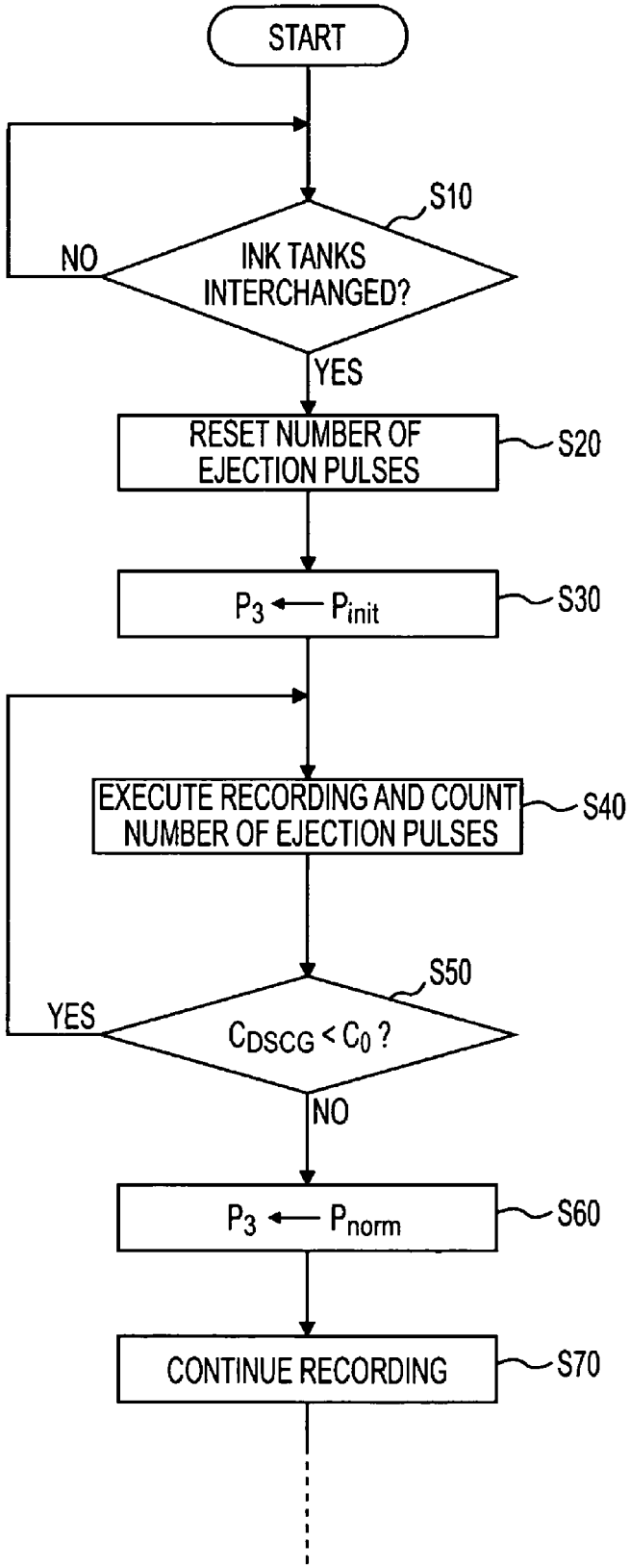
FIG. 7 is a flow chart showing a process of controlling the width of a main heat pulse according to the number of ejection pulses.

FIG. 7 is a flow chart showing a process of controlling the width of the main heat pulse $P_3$ according to the number of ejection pulses.

In Step S10, the ink sensor 500 determines whether the ink tanks are interchanged. If the ink sensor 500 determines that the ink tanks are interchanged, the process proceeds to Step S20 where the number of ejection pulses counted ($C_{DSCG}$) is reset to zero. In Step S30, the width of the main heat pulse $P_3$ is set to an initial value $P_{init}$, which is 0.62 μs in this embodiment, as described above.

In Step S40, the recording head 110 starts recording. During the recording operation, the cumulative number of ejection pulses ($C_{DSCG}$) used for driving the recording head 110 is counted. Step S50 involves determining whether the cumulative number exceeds a threshold $C_0$, which is $2\times10^9$ in this embodiment, as described above.

If $C_{DSCG}<C_0$, the process returns to Step S40 to continue the recording operation with the initial width of the main heat pulse $P_3$ while counting the number of ejection pulses. If $C_{DSCG}\geqq C_0$ the process proceeds to Step S60 where the width of the main heat pulse $P_3$ is set to the normal value ($P_{norm}$), which is 0.5 μs in this embodiment, as described above. The process then proceeds to Step S70 where the recording is continued by driving the recording head 110 with the pulse width $P_{norm}$.

The ink sensor 500 determines that the ink tanks are interchanged in the above description, although the user may perform the determination by pressing a predetermined button on the recording device since the ink tanks are manually interchanged. Alternatively, the user may perform the determination by responding to a message sent from a printer driver installed in the host computer 300 and displayed on the display of the host computer 300.

It should be noted that the values such as $P_{init}$, $P_{norm}$, and $C_0$ are mere examples. Naturally, other values may be used according to the properties of the recording head and inks used.

According to the embodiment described above, increasing the energy supplied to the thermoelectric converters 2 avoids unstable ink ejection due to a mixed ink left immediately after the interchange of the ink tanks. Such increased energy supply can prevent a decrease in ink ejection speed and the resultant decrease in the positional accuracy with which ink droplets are ejected and landed on the recording medium P to enable high-quality image recording.

Because the ejection stabilizes after the mixed ink is consumed and replaced with the ink used after the interchange of the ink tanks, the ejection pulses are adjusted so as to supply appropriate energy. This adjustment prevents the effect of unnecessarily increased energy supply on the lifespan of the recording head 110 and inhibits the deterioration of the recording head 110 while maintaining stable ejection speed.

The black inks used before and after the interchange are both pigment inks in this embodiment described above, although the compositions of the inks are not limited in the present invention. That is, the present invention may be applied to any recording device used with inks that can cause unstable ejection performance when a mixed ink is left in a recording head or ink channels after the interchange of the inks.

The energy supply is controlled to a higher level immediately after the interchange of the inks and is subsequently adjusted to an appropriate level in this embodiment, although the present invention is not limited to the energy control as described above. The energy supply may be suitably adjusted according to, for example, the types of inks and the properties of the recording head used. For example, the energy supply may be controlled to a lower level immediately after the interchange of the inks to avoid unstable ejection associated with the interchange of the inks.

Second Embodiment

In this embodiment, another example of the method for controlling the recording device according to the first embodiment will be described. This method involves stepwise changes in the energy supplied to the recording elements after the interchange of the ink tanks.

Figure 8:
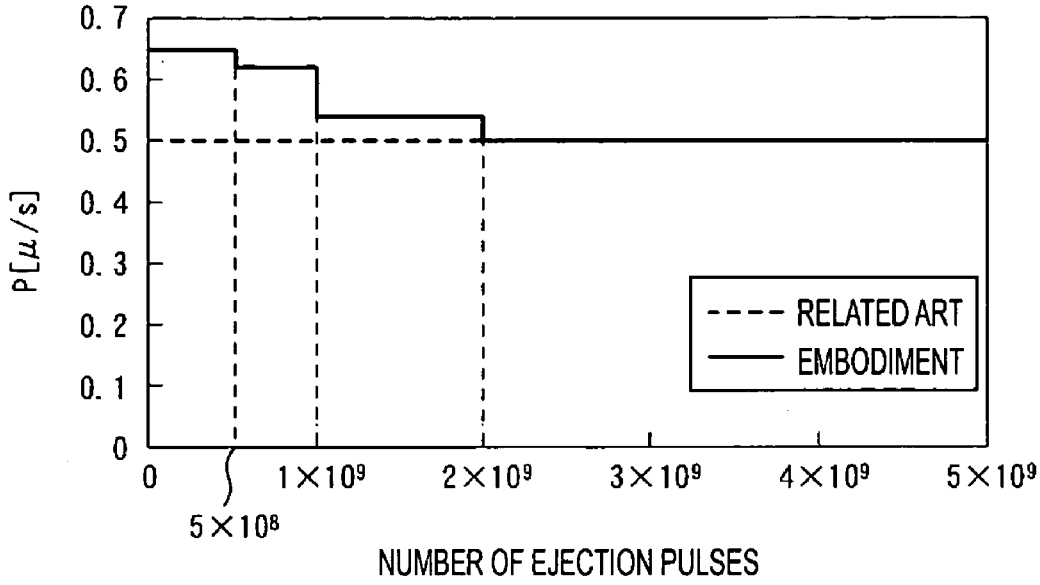
FIG. 8 is a graph showing the relationship between the number of ejection pulses after the interchange of ink tanks and the width of the main heat pulse.

FIG. 8 is a graph showing the relationship between the number of ejection pulses after the interchange of the ink tanks and the width of the main heat pulse $P_3$.

Immediately after the interchange of the inks, as described above, the high content of the residual ink tends to result in unstable ejection properties. Also in this embodiment, the width of the main heat pulse $P_3$ is controlled to 0.65 μs. Because the content of the residual ink decreases slightly after about $5\times10^8$ ejection pulses are supplied, the width of the main heat pulse $P_3$ is controlled to 0.62 μs. After $1\times10^9$ ejection pulses are supplied, the content of the residual ink is fairly low, and a supply of excessive main heat pulses often leads to less stable ejection properties. Accordingly, the width of the main heat pulse $P_3$ is controlled to 0.54 μs to adjust the energy supply to the level optimum for the content of the residual ink. After $2\times10^9$ ejection pulses are supplied, no energy control is needed because the ink used before the interchange of the ink tanks is nearly completely consumed.

Accordingly, the width of the main heat pulse $P_3$ is controlled to 0.5 μs, which is optimum for the ink used after the interchange.

Figure 9:
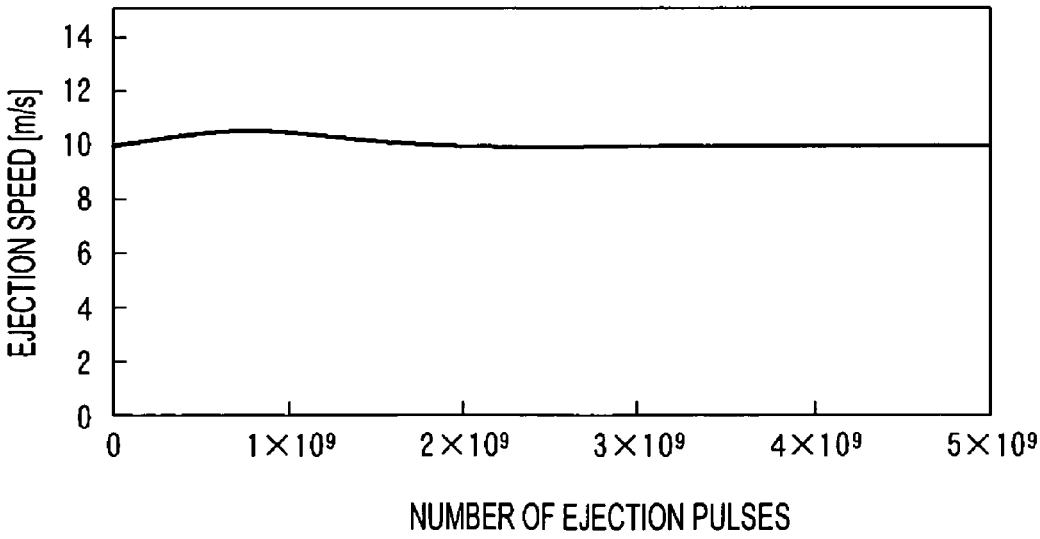
FIG. 9 is a graph showing the relationship between the ejection speed after the interchange of the ink tanks and the number of ejection pulses.

FIG. 9 is a graph showing the relationship between the ejection speed after the interchange of the ink tanks and the number of ejection pulses.

FIG. 9 shows that ink droplets can be ejected at 10 m/s from immediately after the interchange of the ink tanks in this embodiment because the optimum energy can be supplied according to the number of ejection pulses. FIG. 9 also shows that variations in ejection speed with ink consumption remain within ±1 m/s despite the decreasing content of the residual ink because the width of the main heat pulse $P_3$ is suitably controlled. Accordingly, the variations in ejection speed can be inhibited to prevent variations in the positional accuracy with which ink droplets are landed on the recording medium P, thus enabling high-quality image recording.

According to this embodiment, as described above, the energy supply can be optimized for different ink conditions despite the decreasing content of the residual ink by controlling the energy supply stepwise according to the number of ejection pulses after the interchange of the ink tanks. Hence, variations in ejection speed can be minimized as the ink is consumed after the interchange of the ink tanks, thus enabling high-quality image recording with high ejection stability.

The energy supply after the interchange of the inks is controlled in four levels in this embodiment, as shown in FIG. 8, although the number of levels may be suitably adjusted according to, for example, the properties of the inks and the content of the residual ink after the interchange.

The energy supply is controlled by reducing the width of the main heat pulse $P_3$ stepwise in this embodiment, although the method used for adjusting the energy supply is not limited to the above method. For example, the optimum energy supply may be maintained according to the ink conditions by increasing the pulse width stepwise or by changing the width of a pulse other than the main heat pulse $P_3$.

Third Embodiment

While an example of a recording device including recording heads integrated with ink tanks mounted on a carriage has been described in the first and second embodiments, an example of a recording device including a recording head connected to ink tanks through supply tubes will be described in a third embodiment.

Figure 10:
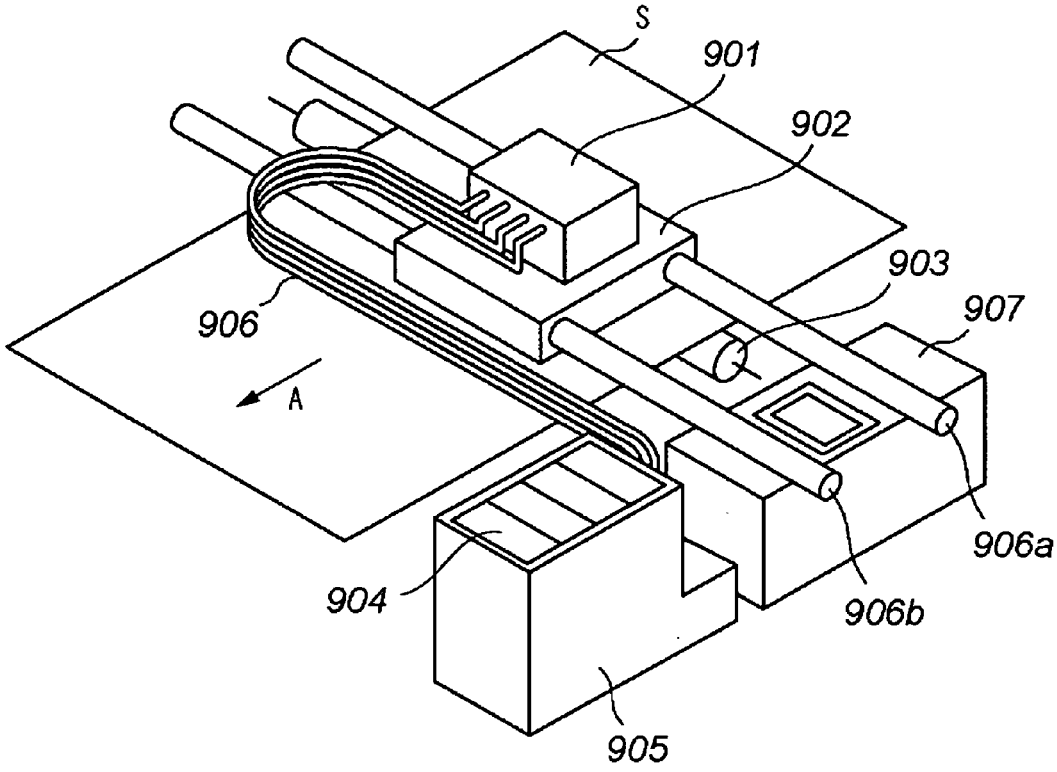
FIG. 10 is a schematic perspective view of a recording device having supply tubes.

FIG. 10 is a schematic perspective view of the recording device having the supply tubes. Parts of the recording device which are not shown in FIG. 10 are basically the same as in the recording device shown in FIG. 1.

In FIG. 10, a recording head 901 is detachably mounted on a carriage 902 that is slidably supported on two guide rails 906*a* and 906*b* and is reciprocated along the guide rails 906*a* and 906*b* by, for example, a carriage motor. A recording sheet S is conveyed by a conveyor roller 903 in a direction perpendicular to the movement direction of the carriage 902 (for example, in a perpendicular direction indicated by arrow A) such that the recording sheet S faces the ink-ejection surface of the recording head 901 with a predetermined distance maintained therebetween. The recording head 901 has nozzle arrays for ejecting inks of different colors. These nozzle arrays extend substantially perpendicularly to the scanning direction of the recording head 901 (i.e., the movement direction of the carriage 902).

Independent main tanks 904 corresponding to the individual inks ejected from the recording head 901 are detachably attached to an ink supply unit 905. The ink supply unit 905 is connected to the recording head 901 through supply tubes 906 corresponding to the individual inks. The main tanks 904 can be attached to the ink supply unit 905 to independently supply the individual inks stored in the main tanks 904 to the nozzle arrays of the recording head 901.

The main tanks 904, the ink supply unit 905, and the supply tubes 906 form ink supply channels for supplying the inks to the recording head 901. The main tanks 904 are detached from the ink supply unit 905 and replaced with new main tanks for ink interchange. The ink supply unit 905 includes an ink sensor (not shown) for determining the type of ink.

In FIG. 10, a recovery unit 907 is provided in a non-recording region outside the region where the recording sheet S is conveyed within the range of reciprocating motion of the recording head 901. This recovery unit 907 is disposed adjacent to the ink supply unit 905 so as to face the ink-ejection surface of the recording head 901. The recovery unit 907 forcibly sucks ink and air out of the outlets of the ejection nozzles of the recording head 901 to clean the nozzles and charge inks into the recording head 901.

Figure 11:
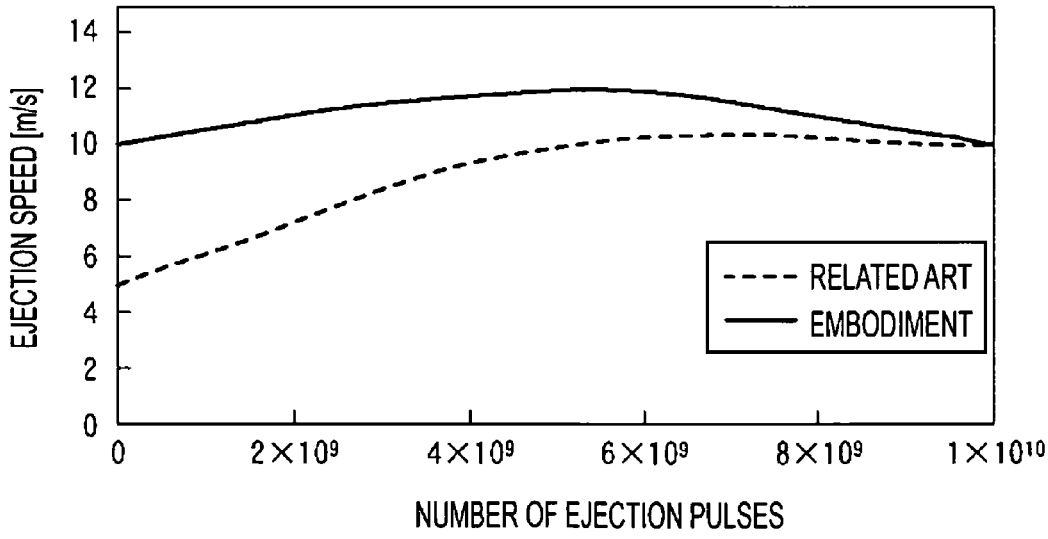
FIG. 11 is a graph showing the relationship between the number of ejection pulses and ink ejection speed after the interchange of ink tanks for the recording device according to a third embodiment and a recording device of the related art.

FIG. 11 is a graph showing the relationship between the number of ejection pulses and ink ejection speed after the interchange of the ink tanks for the recording device according to this embodiment and a recording device of the related art.

A residue of the ink used before the interchange of the ink tanks is left in the ink supply unit 905 and the supply tubes 906 and is mixed in the ink used after the interchange. The mixed ink, which remains until about $5\times10^9$ ejection pulses are supplied, often results in unstable ejection performance and decreased positional accuracy with which ink droplets are ejected and landed on a recording medium, thus leading to degraded recording image quality.

The recording device according to this embodiment ensures stable ejection performance by controlling the width of the main heat pulse $P_3$ to 0.62 μs until about $5\times10^9$ ejection pulses are supplied. The recording device changes the width of the main heat pulse $P_3$ to 0.5 μs when the amount of ink equivalent to about $5\times10^9$ ejection pulses is consumed after the interchange of the ink tanks.

According to the embodiment described above, stable ink ejection is ensured even when the mixed ink is left in the recording device after the interchange of the ink tanks and also after the subsequent ink consumption completely replaces the mixed ink with the ink used after the interchange. The recording device therefore enables high-quality image recording.

Other Embodiments

According to the embodiments described above, a recording head is driven and controlled according to the number of drive pulses counted after the interchange of ink tanks, although the present invention is not limited to pulse counting. That is, the recording head may be driven and controlled according to the results obtained by any method that can determine ink consumption after the interchange of the ink tanks.

The method used for determining ink consumption is not limited to pulse counting as described in the above embodiments. For example, the amount of ink ejected may be estimated from recording data. For a recording device including a recording head connected to ink tanks through tubes to supply inks through the tubes, a mechanical method may be employed to determine the amount of ink flowing through the tubes. For a recording device capable of detecting changes in the amount of ink remaining in ink tanks, ink consumption may be determined according to the results obtained by detecting a decrease in the residual amount of ink after the interchange of the ink tanks. That is, the present invention may be applied to any recording device that can determine ink consumption after the interchange of ink tanks.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Application No. 2005-063155 filed Mar. 7, 2005, which is hereby incorporated by reference herein in its entirety.

What is claimed is:

1. A recording device for recording an image, comprising:

a recording head configured to eject ink;

an ink tank configured to store the ink to be supplied to the recording head, the ink tank being one of first and second ink tanks, the first ink tank being interchangeable with the second ink tank;

a determining unit configured to determine whether the first ink tank has been interchanged with the second ink tank;

a drive unit configured to drive the recording head by applying pulsed signals to the recording head to supply energy thereto;

a counting unit counting the number of pulsed signals applied to the recording head;

a comparing unit comparing a predetermined threshold with the number of pulsed signals counted by the counting unit, the comparison by the comparing unit being responsive to the determining unit determining that the first and second ink tanks have been interchanged; and a drive control unit controlling the energy supplied to the recording head according to the comparison by the comparing unit, wherein the energy supplied to the recording head in recording the image is changed, wherein the inks stored in the first and second ink tanks are pigment inks of the same color and of different components, and by interchanging the first ink tank with the second ink tank, ink supplied from the first ink tank, which has been previously mounted, and remaining in a channel of the head, and ink from the newly-mounted second ink tank are mixed in the channel in the head, wherein the drive control unit controls the energy supplied to the recording head such that ink is discharged during recording at a first supply level, the first supply level is a pulse signal for stably discharging the ink where the inks from each of the first and second ink tanks are mixed, after the interchange of the first and second ink tanks until the number of pulsed signals counted by the counting unit reaches the predetermined threshold and controls the energy supplied to the recording head at a second supply level corresponding to the ink of the second ink tank after the number of pulsed signals reaches the predetermined threshold, the first supply level being higher than a supply level before the interchange, the second supply level being lower than the first supply level, and wherein the predetermined threshold is the number of driving required for completely flushing from the head the mixed ink, mixed inside the head by the interchange of the ink tanks, by ejection, so that the mixed ink no longer remains, and only unmixed ink from the second ink tank remains in the head.

2. The recording device according to claim 1, wherein the drive unit drives the recording head by applying a pulsed signal including divided pulses for each ink ejection operation, the divided pulses including a preheat pulse for controlling the temperature of the inks and a main heat pulse that contributes directly to the ejection of the inks.

3. The recording device according to claim 2, wherein the drive control unit controls the energy supplied to the recording head by changing the duration of the main heat pulse according to the number of pulsed signals counted by the counting unit after the interchange of the first and second ink tanks.

4. The recording device according to claim 3, wherein the drive control controls changing the duration of the main heat pulse stepwise.

5. The recording device according to claim 1, further comprising a carriage that reciprocates with the recording head mounted thereon, wherein the ink tank is mounted on the carriage and is reciprocated together with the recording head.

6. The recording device according to claim 1, further comprising:

a carriage that reciprocates with the recording head mounted thereon; and a tube that connects the ink tank to the recording head to supply the ink from the ink tank to the recording head.

7. A recording control method for controlling the recording of an image by the ejection of ink from a recording head that is supplied with the ink from an ink tank being one of first and second ink tanks, the first ink tank being interchangeable with the second ink tank, the method comprising the steps of:

determining whether the ink tanks have been interchanged;

driving the recording head for image recording by applying pulsed signals to the recording head to supply energy thereto;

counting the number of pulsed signals applied to drive the recording head;

comparing a predetermined threshold with the number of pulsed signals counted, the comparison being responsive to the determination that the first and second ink tanks have been interchanged;

interchanging the first ink tank with the second ink tank, wherein ink supplied from the first ink tank, which has been previously mounted, remains in a channel of the head, and mixes with ink from the newly-mounted second ink tank in the channel in the head, controlling the energy supplied to the recording head such that ink is discharged during recording at a first supply level, the first supply level is a pulse signal for stably discharging the ink where the inks from each of the first and second ink tanks are mixed, after the interchange of the first and second ink tanks until the number of pulsed signals counted by the counting unit reaches the predetermined threshold and controlling the energy supplied to the recording head at a second supply level corresponding to the ink of the second ink tank after the number of pulsed signals reaches the predetermined threshold, the first supply level being higher than a supply level before the interchange, the second supply level being lower than the first supply level, and wherein the predetermined threshold is the number of driving required for completely flushing from the head the mixed ink, mixed inside the head by the interchange of the ink tanks, by ejection, so that the mixed ink no longer remains, and only unmixed ink from the second ink tank remains in the head.

* * * * *